US008210271B2

(12) United States Patent
Gibbs

(10) Patent No.: US 8,210,271 B2
(45) **Date of Patent: *Jul. 3, 2012**

(54) VAPOR RECOVERY AND FIRE SUPPRESSION SYSTEM FOR OIL SKIMMER

(76) Inventor: Paul Gibbs, Midland, TX (US)

( * ) Notice: Subject to any disclaimer, the term of this patent is extended or adjusted under 35 U.S.C. 154(b) by 445 days.

This patent is subject to a terminal disclaimer.

(21) Appl. No.: 12/476,933

(22) Filed: Jun. 2, 2009

(65) Prior Publication Data

US 2009/0321089 A1 Dec. 31, 2009

Related U.S. Application Data

(60) Provisional application No. 61/058,251, filed on Jun. 3, 2008.

(51) Int. Cl.
*A62C 2/00* (2006.01)

(52) U.S. Cl. ..... 169/46; 210/776

(58) Field of Classification Search ..... 169/46, 169/43, 45, 47, 66; 210/776, 800, 122, 188, 210/242.3, 537–540; 95/253; 96/182, 183
See application file for complete search history.

(56) References Cited

U.S. PATENT DOCUMENTS 2,079,438 A 5/1937 Ellis
2,348,938 A 5/1994 Stahl et al.
5,314,027 A 5/1994 Wood
5,425,886 A 6/1995 Smith
5,592,963 A * 1/1997 Bucci et al. ..... 137/202
5,826,664 A * 10/1998 Richardson ..... 169/46
6,237,694 B1 * 5/2001 Chan ..... 169/43
7,504,037 B2 * 3/2009 Gibbs ..... 210/776

OTHER PUBLICATIONS

PCT/US2009/046039 International Search Report, dated Oct. 26, 2009,.9 pages.

* cited by examiner

*Primary Examiner* — Davis Hwu
(74) *Attorney, Agent, or Firm* — Merek, Blackmon & Voorhees, LLC

(57) ABSTRACT

One or more aspects of the present invention is directed to a fire suppression system for use with an oil and vapor recovery system, such as for example, a system having a float system for adjusting the height of oil and vapor recovery intakes. The float system is preferably adjustable to allow connection of additional floats to maintain buoyancy and keep the vapor intake above the level of the oil in the holding tank and to maintain the oil intake above the level of the water contained in the holding tank. Vapor is drawn out of the holding tank using a vacuum assisted siphon. Oil can be withdrawn from the holding tank by suction or simply by letting the oil flow into an outlet by gravity. By reversing the flow of the existing suction pipes or by providing additional inlet pipes to the nozzles, fire suppression or other chemicals can be added to the tank without having to gain physical access to the tanks, thereby potentially saving lives, money as well as the fluids within the tanks.

10 Claims, 4 Drawing Sheets

VAPOR RECOVERY AND FIRE SUPPRESSION SYSTEM FOR OIL SKIMMER

CROSS-REFERENCE TO RELATED APPLICATIONS

This application claims the benefit of U.S. Provisional Application Ser. No. 61/058,251 filed Jun. 3, 2008, which application is incorporated herein by reference.

FIELD OF THE INVENTION

The present invention according to one aspect relates to an oil recovery system for a fire prevention system for use during the extraction of oil from subterranean oil bearing strata. More particularly, the invention relates to a method and system capable of extinguishing or preventing fires inside a oil separation tank.

BACKGROUND OF THE INVENTION

In the extraction of crude oil from underground oil bearing formations, water is often mixed with the extracted oil due to naturally occurring underground water or due to injected water from secondary recovery operations. The oil must be separated from the water so that the oil can be transported off the well site. To separate the oil from the water, holding tanks are set up at the well site and the oil floats to the top. Further, various vapors including oil vapor and/or natural gas separate from the oil and gas mixture and float above the oil inside the holding tank, causing a potential combustible situation. As the level between the oil and water and vapor and oil fluctuates within the holding tank depending on the relative concentrations of water, oil and vapor being extracted from the well, a height adjustable device containing siphons to remove the separated, water, oil and vapors is necessary to compensate for the fluctuating levels. Since oil and vapors such as methane found in these tanks, fires are a concern and can do substantial damage when they arise. Additionally, the release of these vapors from the often open-air vented tanks may be environmentally hazardous.

When a fire does break out or is likely to break out, it is difficult for fire or rescue crews to address the area inside the tank. By the time a crew can get to the area of the fire, a significant amount of damage has been done either by the fire or by destroying equipment to get to the fire. What is needed is a fire containment system that addresses the inside of the tank area that can be economically provided without significantly increasing the complexity and efficiency of the tank operation.

OBJECTS AND SUMMARY OF THE INVENTION

It is an object of at least one aspect of the invention to provide a fire suppression system for use with an oil production and oil/vapor separation and holding tanks.

Another object of the invention according to at least one embodiment is to provide an improvement to an apparatus for removing oil and/or vapors from an oil production holding tank and automatically adjusting to the levels of oil and water in the holding tank, wherein the improvement comprises a line or lines for supplying nitrogen, foam or other fire suppression means to the interior of the tank.

An additional object of the invention is to add chemicals to a fluid holding tank by reversing the flow of outlet pipes to allow chemicals to be injected.

It is an another object of the invention to add chemicals to a multilayer fluid in a tank by using nozzles located automatically at various levels within the tank to treat different fluids separately within the tank.

It is a further object of an aspect of the invention to add chemicals to treat different fluids separately by using inlet hoses or by reversing the flows within existing hoses to reach various areas within the tank.

Other objects and advantages will be apparent to those skilled in the art upon review of the detailed description of the invention and accompanying drawings appended hereto.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one or more aspects of the present invention is directed to a fire suppression system for use with an oil and vapor recovery system, such as for example, a system having a float system for adjusting the height of oil and vapor recovery intakes. The float system is preferably adjustable to allow connection of additional floats to maintain buoyancy and keep the vapor intake above the level of the oil in the holding tank and to maintain the oil intake above the level of the water contained in the holding tank. Vapor is drawn out of the holding tank using a vacuum assisted siphon. Oil can be withdrawn from the holding tank by suction or simply by letting the oil flow into an outlet by gravity.

When suction is used to draw the oil out of the holding tank, an intake is used having preferably an opening or multiple openings to direct suction upward to help prevent coning of water and provide for more efficient removal of oil with less water drawn in when the oil layer gets thinner.

The buoyancy system uses vertically spaced floats having different buoyancy rates ("levels"). The lower floats are buoyant in water but not in oil to maintain the oil outlet above the water level in the holding tank while the upper floats are buoyant in oil and maintain the vapor outlet above the oil level in the holding tank.

A fire suppression system is provided by adding an extra line parallel to the vapor siphon line for adding nitrogen or foam or other fire suppression means into the tank. In another embodiment, the existing or added single siphon line can be made reversible to provide fire suppression means through the siphon line into the tank. In another embodiment, other chemicals or materials can be added to the system to prevent the formation of hazardous vapors or for other purposes. In a most preferred embodiment, two siphon or outlet lines are normally provided in the tank, one line to siphon gas or vapor such as methane from the area above the oil and the other line to draw oil from the tank. Each line may be made reversible so that, for example, one line can be used to supply nitrogen to the tank and the other line can be reversed to provide foam into the tank during an emergency or for other purposes.

DETAILED DESCRIPTION OF THE PREFERRED EMBODIMENT

Figure 1:
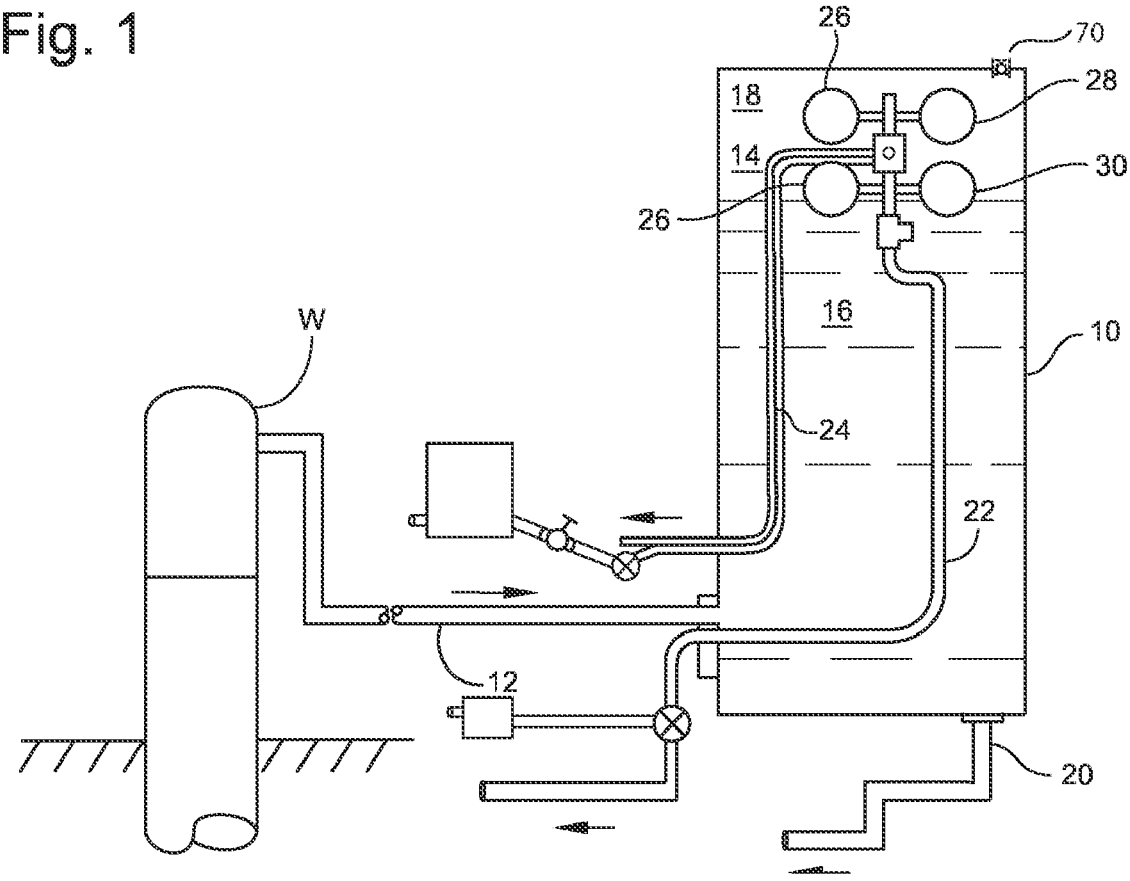
FIG. 1 is a schematic view of the buoyancy system and fire suppression system.

FIG. 1 shows an exemplary system that can be built using a fire suppression system according to the invention. The system shown in FIG. 1, without the fire suppression system according to the present invention is described in co-pending U.S. application Ser. No. 11/783,437, filed Apr. 10, 2007, which is incorporated herein by reference. FIG. 1 of the present invention shows a schematic view of a holding tank 10 for receiving oil/water mixture according to a preferred embodiment of the invention. The tank may be closed at the top or may be open to the atmosphere, depending for example on the nature of the vapor produced. As the oil/water mixture is pumped into the holding tank 10 from inlet pipe 12 the oil 14 separates from the water 16. Additionally, vapor 18 which may be oil vapor, methane, natural gas or other flammable or non-flammable gases may collect above the oil 14. Water 16 is drained or pumped from tank 10 via outlet pipe 20, and may be returned to the well W for reuse. Oil 14 is drained or pumped from the tank 10 via flexible oil recovery hose 22 and sent to a separate holding tank or pipeline for transport to a refinery. Likewise, gas or vapor 18 may be removed via a vacuum hose 24 and sent to another holding tank or pipeline for transport to a refinery.

The oil recovery hose 22 is constructed of flexible oil resistant material such as neoprene or other plastic material having properties necessary to withstand corrosive substances commonly found in crude oil. The oil recovery hose 22 is supported within the tank 10 by floats 26. Floats 26 may be formed of rubber, plastic or stainless steel or other suitable material that is both buoyant and resistant to corrosive substances commonly found in crude oil. As can be seen in FIG. 1, floats 26 may optionally include an upper set of floats 28 and a lower set of floats 30 or may include only the upper or lower set.

Figure 2:
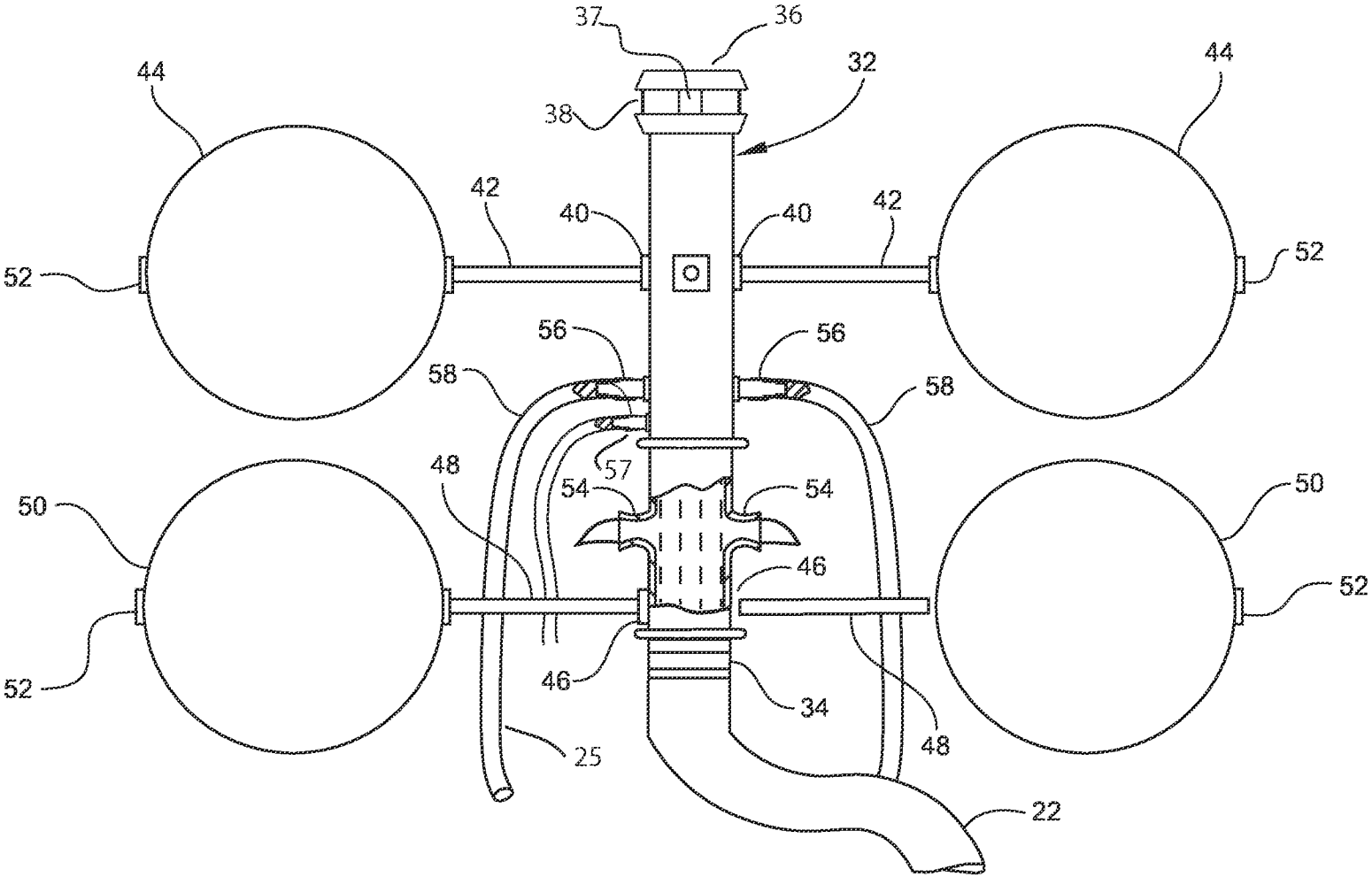
FIG. 2 is a schematic view of an upper portion of the buoyancy system of FIG. 1.

Now with reference to FIG. 2, it can be seen that oil recovery hose 22 includes a preferably rigid pipe component 32 joined thereto at connection 34. At the upper end of the pipe component is a top or cap 36 spaced apart from component 32 by braces 37 to form openings 38 therein. Spaced downwardly from the upper end 34 are upper attachment ports 40 for connecting upper float arms 42 extending from upper floats 44. Lower attachment ports 46 are spaced below upper attachment ports 40. Lower float arms 48 extend from lower attachment ports 46 and join lower floats 50 to the lower attachment ports 46. Upper floats 44 and lower floats 50 have additional attachment ports 52 so that additional floats 46 or 50 can be added for greater buoyancy.

It is important to note that the buoyancy of upper floats 44 is greater than that of lower floats 50 so that lower floats 50, while being buoyant in water 16 are not buoyant in oil 14. Upper floats 44 are buoyant in both water 16 and oil 14. Using this difference in buoyancy between the upper floats 44 and the lower floats 50, the top 36 is maintained above the upper level of the oil 14 and the oil drain openings 54 are maintained above the upper level of the water 16.

Vacuum hose ports 56 are located above the oil drain openings 54 to prevent oil from being drawn into the vacuum hoses 58 which draw the vapor through the openings 38 of cap 36 and transport the vapors out of the tank 10.

Figure 3:
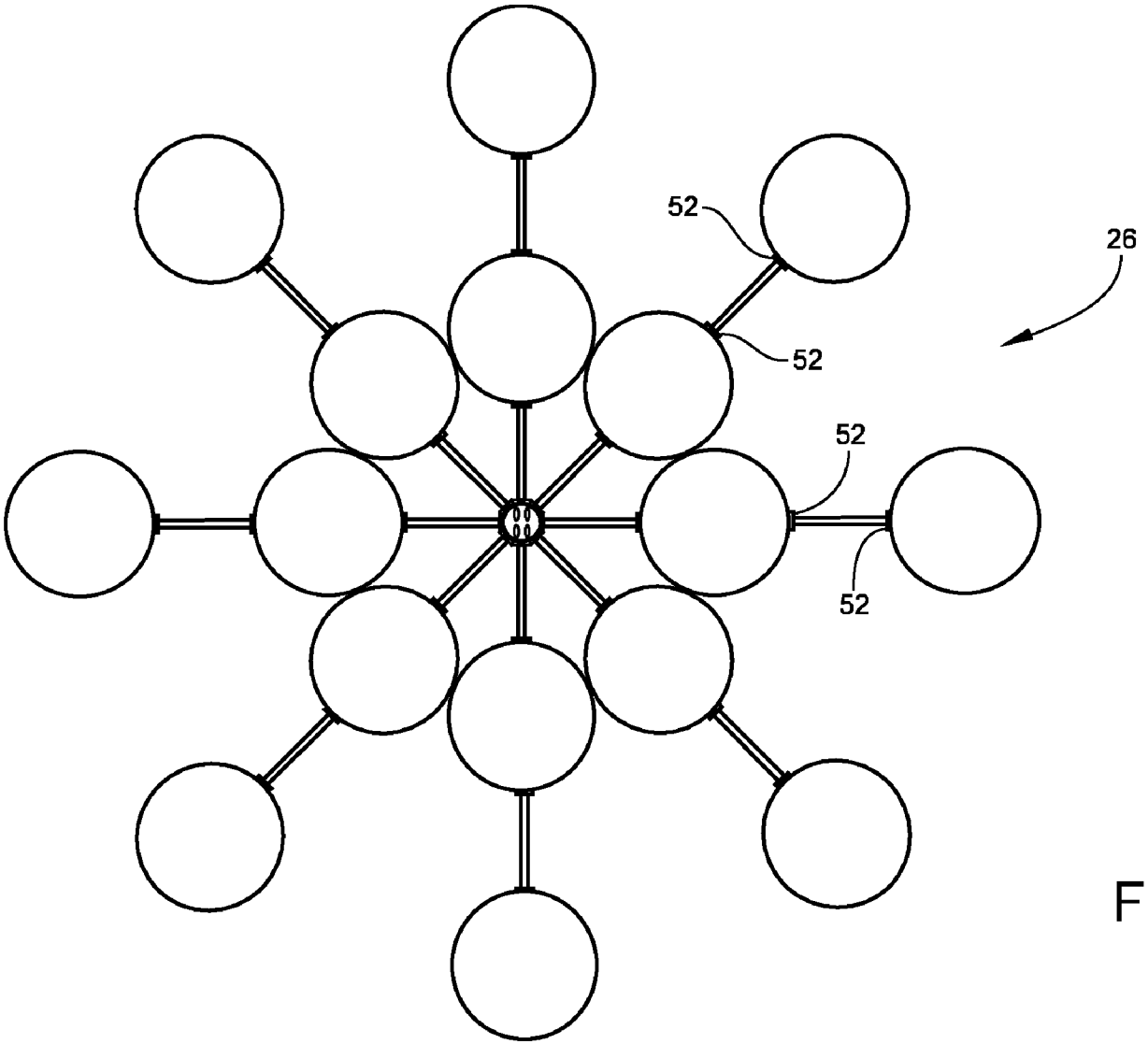
FIG. 3 is a top view of the vapor intake and float system.

Now with reference to FIG. 3, an array of floats 26 is shown. Using attachment ports 52, floats 26 can be added or removed to control buoyancy.

Factors affecting buoyancy include the weight of the hoses 22 and 58 which may vary due to changes in diameter and materials thus requiring an adjustment of the number of floats 44 and/or 50 to achieve the correct calibration.

Figure 4:
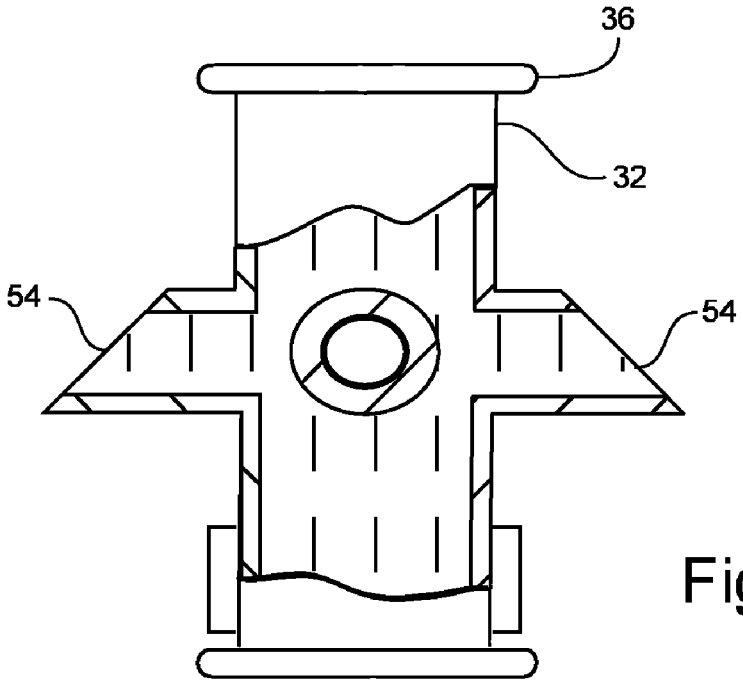
FIG. 4 is a side view of the oil outlet with portions broken away.
Figure 5:
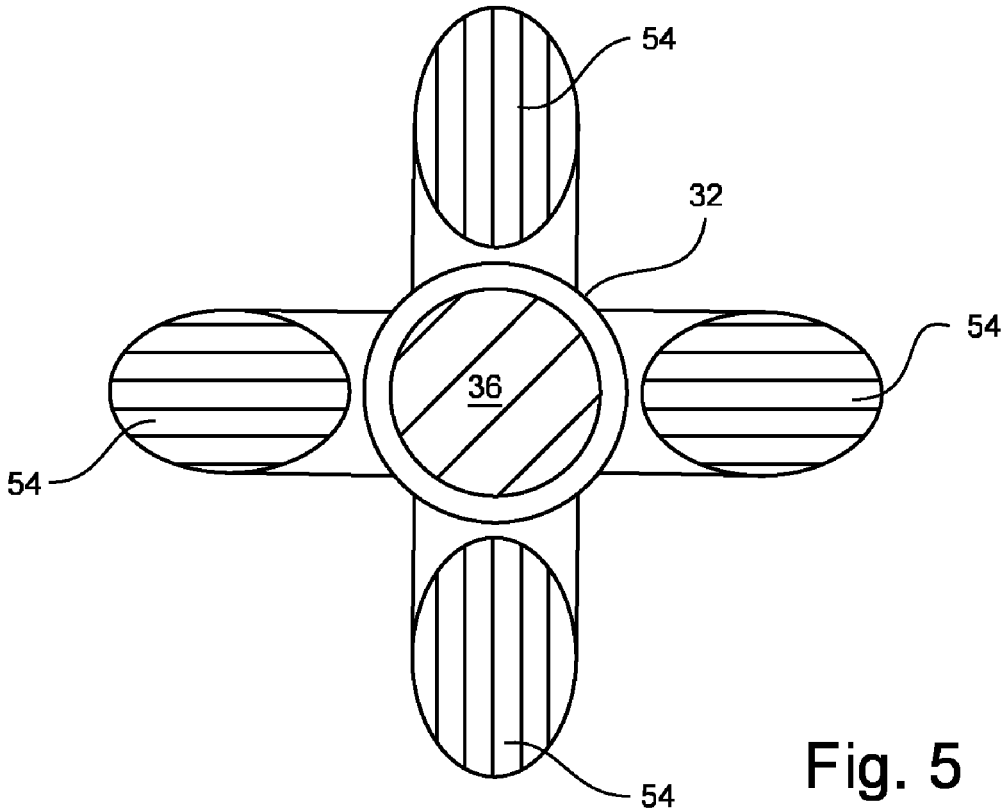
FIG. 5 is a top view of the oil outlet of FIG. 4.

FIGS. 4 and 5 show detailed views of the preferred embodiment of oil drain openings 54. The drain openings are spaced about a portion of the pipe component 32 and open upwardly. The upwardly opening design aids in the prevention of water being drawn up into the oil drain openings since any whirl pooling caused by the flow of oil 14 into the drain openings 54 will extend upwardly away from the water 16. FIG. 4 shows the openings 54 extending outwardly from the pipe component 32.

In order to protect the system against fires or to reduce the deleterious effects of fire or hazardous materials, a fire suppression system according to a preferred embodiment of the invention may be installed to allow fire suppression gases, liquid, foams, chemicals or the like into the interior compartments of the system. The fire suppression may take advantage of existing pipes and hoses in the system, or may replace or supplement the existing hose and pipes by a dual pipe system.

FIG. 1 shows both one added line and one modified line, though more than one line could be modified or both lines could be modified without departing from the scope of the invention. Line 24 has been added next to line 25. These lines may be next to each other, separated from each other, side by side, concentric, etc. In practice, line 24 could be replaced with a line having two chambers or two separate lines could be provided that are optionally attached together. Preferably, the connector component 32 is made or modified to accept two hoses or pipes 24,25 in communication with openings 38. Where multiple vacuum lines 24,58 are provided as shown in FIG. 2, one fire inlet line 25 may be provided for each vacuum line or only one inlet line total may be provided. The inlet line may be have the same interior diameter of the vacuum line or may be of a different size to handle the liquid, gas or foam to be piped through the fire inlet hose 25 and opening(s) 38. Additionally, while separate ports 56,57 are shown accepting hoses 56,57, one port may be provided for accepting both hoses or a combined hose.

Referring again to FIG. 1, the end opposite port 57 of line 25 is connected to a flow control device such as a valve 62. The valve may be automated or manually activated. The valve automation may be in response to fire, heat or pressure, or may respond to a monitor, emergency crew or other personnel activating the fire suppression system. A tank 60 containing nitrogen, foam or other chemical or agent may be provided or connected to the fire suppression system permanently or temporarily to aid in suppressing a fire or explosion. The tank may be on a vehicle, such as a fire emergency vehicle or a cart that can be moved into place, remote from the tank, but close enough to minimize the volume of fluid or gas in the hose before being applied to the tank. However, preferably, the tank is permanently attached to one or more tank. If necessary a pump 64 may be provided to assist in moving the fire suppression chemicals or gases to the tank or to pressurize the same. An inlet 68 may be provided to replenish the tank to connect a portable or supplementary tank (not shown).

Line 22 connected to inlet 54 is also modified to allow fire suppression chemicals or gases to be pumped into tank 10. A valve 72 is provided at the inlet or at a point downstream of the inlet 54. The valve 72 allows fluid to normally be pumped or conveyed from the inlet 54 to a holding tank or pipeline for transport to a refinery (not shown). The valve is also in communication with a separate inlet hose or pipe 23. The hose may be connected to a tank or housing 66 storing fire suppression gases, liquids or foams for use in suppressing a fire. As discussed in relation to line 25, the housing could be temporary or permanent and may have a supplementary inlet for supplying materials to the tank 66. The tank 66 may be the same as, connected to, or separate and independent from tank 60. A pump or pressurizing means may be provided in the tank or on line 23 or the like to provide motive force or pressurization of the fire suppression materials. Preferably, tanks 60 and 66 contain different fire suppression materials from each other to enhance the overall chance or suppressing a fire by hitting it with more than one type of chemical, gas or agent. In operation, the valve 72 on line 22 can by switched from communicating the tank from the line outlet such as a vacuum source to the fire suppression fluid inlet line 23. In this way line 22 can be reversed under pressure of the incoming fluid in line 23 to receive the fire suppression gas or foam or other agent to pipe the same to tank 10.

The pumps, valves, and elements of the fire suppression system may have their own power source such as a generator or battery as a main or back up power source, so that the system may operate when the main power is cut, for example, by the source of the tank fire or is cut by an explosion in one or more of the tanks.

In an emergency situation such as a fire or explosion or unsafe condition, it may become necessary to pump a fire suppression chemical or gas into tank 10. Normally, a fire caused by lightning strike, static, heat, acts of God, or operator errors or the like causes a rent in the roof of the tank during explosion of the vapors, such as methane, in the tank. For this reason, the tank may be designed with a weakened seam to allow the tank to break safely at an upper periphery to avoid breakage or leaks below the liquid level line to avoid undue spillage of flammable products. A pressure relief valve 70 may also be provided in the tank 10 to automatically release pressure in an overpressure situation if a rent does not occur.

To combat such a hazard, fire personnel in the past have used a natural opening in the tank from the explosion to pump in nitrogen or foam or other agents into the tank. This required personnel to first be contacted, then for the personnel to arrive at the site and to come in close contact with potentially hazardous tank. In the present invention, however, it is only necessary to automatically or manually activate the fire suppression system. The tank can then be flooded by a gas such as nitrogen pumped into the space above the liquid 16 to replace the oxygen in the area above the tank to starve out the fire. Alternatively, or in addition, foam can be pumped into the tank to smoother or kill the fire.

In the embodiment according to FIG. 1, valve 62 is actuated automatically or manually to connect line 25 with tank 60. If necessary, pump 64 pumps gas from tank 60 through line 25 to the space above the liquid 16 via opening 38 to starve the fire by replacing the oxygen in the tank. If necessary a pump may be used to pressurize the gas prior to piping the nitrogen to tank 10. The pump may be more necessary if a material other than pressurized gas is provided in the tank 60, such as foam or other chemicals. At the same time, line 24 may be shut down by a valve or other means to prevent fluid or vapor from returning to the tank and to prevent spread of the fire through line 24.

In addition to or alternative to the nitrogen gas pumped through line 25, a fire suppressant foam may be provided to the tank through line 22. Valve 72 is manually or automatically activated to shut off the flow of fluids from the tank through valve 72 to a point downstream such as a holding tank. Simultaneous to shutting flow down line 22 or subsequent to shutting down line 22, tank 66 is placed in communication with line 22 to pipe a fire suppression material, such as foam. The foam is then piped through line 22 to the tank 10 via port 54 to suppress the fire or to seal the materials in the tank from the source of the flame or other potential hazard, which used proactively. One skilled in the art would recognize that additional fire suppression systems, including but not limited to additional lines from disparate sources could be used to prevent or control other types of fire or for use with different, specific materials in the tank to provide redundant fire suppression systems without departing from the scope of the invention. In this way, fire personnel or plant personnel can suppress or avoid a tank fire by automated means without having to approach or come in close contact to the tank and/or fire. The inlet lines also provide fire or emergency personnel with a way to pipe materials, such as fire suppression gases or foams, into the tank without having to approach the tanks too closely, thereby potentially saving lives or severe injuries to emergency crew and other personnel.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention. For example, the system may be used to pump other materials into the tanks for reasons other than fire suppression or prevention. Disparate chemicals could be provided into various lines or only in some lines to treat different fluids using different chemicals or only to treat the vapor or fluids. While two levels are shown in the drawings, other nozzles could be provided to treat the fluids at different levels such as the bottom of the tank or if additional fluids or vapors were know to separate at additional levels, nozzles buoyant to the appropriate additional levels could be added. For example, in a particular tank, water may be the bottommost layer and it may be easiest to pump the water from the bottom of the tank instead of at the separation level. However, the nozzle at the separation level may be used instead of the bottom-located nozzle to prevent, for example, sediment in the bottom of the tank from being disturbed, such as in a refinery, power plant or other process water storage area to extend the life of the pumps and filters.

The following are illustrative examples of how one or more aspects of the present invention might be used, but do not limit the invention's other uses:

1. Oil production tanks, onshore and offshore. The inventive tool has the capability to recover methane gas, draw liquid from the top level to treat bad oil and transfer oil. It also has the ability to inject chemical through it to the top level, letting the chemical disperse at the top level, allowing it to fall through the bad oil treating it. It also has the capability to reverse its flow out of the tank and go back into the tank with inert gas such as nitrogen. It also can do the same with fire fighting foam to blanket the oil from the flames, sealing the oil and vapors underneath. By doing this the fire department, or manufacturing facility does not have to be directly at the tank location to extinguish fire.
2. Oil transfer tanks/pipeline-storage tanks will have different gravities of oil in them, this tool allows you to pull from the top, the lighter gravity and work your way down to the heavy gravity.
3. Refineries may have many different hydrocarbon tanks that are on a continuous feed, and when the tank becomes contaminated, for example with water, the water will be at the bottom of the tank, where the suction lines off the tank are located. By using the present invention, it is possible to pull from the top level (hydrocarbon), down to the water.

4. Produced water tanks/water flood stations may occur where a large volume of produced water is stored for circulation into the produced zone and brought back to the tanks. There is always a carryover of oil to these water tanks. By having the present invention in a tank, it is possible to pull from the top down, recovering the hydrocarbons and putting them back to the oil tanks for sale. This keeps the water tanks all water and produces money for the oil producer.
5. Process water storage that is used for cooling or other purposes in processes such as electrical power plants, refineries, and chemical plants may also benefit from the present invention. By pulling liquid level from the top down, less sediment than what is on the bottom of the tank is pumped, creating a longer life span for our equipment and filters.
6. Potable water tanks can also benefit. By pulling from the top, we will bring in a much better tasting quality of water than pulling off the bottom where sediment rests.
7. In food processing plants, the present invention allows fats to be skimmed off the top creating a leaner food process.
8. In the drilling industry, unbalanced drilling is in great demand. This is where they allow the well to produce while it is being drilled. There is water, gas and oil coming out of the hole into the tanks. The oil will be the top level, where the present invention can be used to efficiently pull the oil from the top. The vapors can be also be recovered, leaving the water cleaned for subsequent use in drilling purposes.
9. Any tank that has more than one phase can be separated. The oil sands of Colorado, Wyoming and Canada would see a big benefit of using this tool when they steam the dirt that has the contaminated oil in it, which (a.) releases the oil, (b.) steam condenses to water, (c.) heat creates vapor off the oil. Using the present invention, all three phases can separated and captured.
10. Any tank with more than one phase can benefit from the present invention.

I claim:

1. A fire suppression system for an oil and vapor recovery apparatus comprising;

a) a holding tank for receiving fluids containing oil and water;
b) an inlet pipe for supplying fluids containing oil and water to said holding tank;
c) a float apparatus located in said holding tank and said float apparatus having buoyant floats connected thereto;
d) an oil recovery pipe connected to said floats and said oil recovery pipe having an oil receiving opening therein for draining oil from said holding tank;
e) a vapor receiving opening in said oil recovery pipe for removing vapor from said holding tank;
f) a vacuum apparatus connected to said oil recovery pipe located above said oil receiving opening; and
g) said vacuum apparatus having a hose connected to said oil recovery pipe for removing vapor from said holding tank;
h) an inlet for receiving fire suppression material from a source;
i) valving to selectively introduce the fire suppression material into said holding tank from said source.

2. The fire suppression system of claim 1, wherein said valving is located between said source and said oil receiving pipe for communicating said fire suppression materials with said vapor receiving opening.

3. The fire suppression system of claim 1, wherein said oil receiving pipe has a reversible flow for selectively pumping oil or vapor out of said holding tank or pumping fire suppression materials into said holding tank.

4. The fire suppression system of claim 3, wherein said fire suppression material is nitrogen introduced above said oil in said holding tank for replacing the oxygen in said holding tank.

5. The fire suppression system of claim 1, wherein said valving is located between said source and a fire suppression hose connected to the interior of said holding tank for communicating said fire suppression materials with said holding tank.

6. A method of suppressing or avoiding fire in a separation tank comprising the steps of:

a) introducing a quantity of water and oil into a separation tank;
b) allowing said oil and water to separate;
c) selectively removing oil from said separation tank using a system of floats to maintain an oil drain opening above said water connected to an oil recovery pipe;
d) selectively removing vapor from said separation tank using a vacuum apparatus connected to said oil recovery pipe located above said oil drain opening, wherein said vacuum apparatus has a hose connected to said oil recovery pipe for removing vapor from said holding tank;
e) providing an oil recovery pipe valve on said oil recovery pipe outside of said holding tank for selectively allowing flow of fluids out of the holding tank to a downstream location or connecting the interior of said holding tank to a fire suppression material inlet;
f) providing fire suppression materials to said fire suppression material inlet and pumping said fire suppression materials into said tank using said oil recovery pipe.

7. The method of suppressing or avoiding fire in a separation tank of claim 6, wherein the fire suppression materials inlet includes a receiver for receiving a hose of a fire truck.

8. The method of suppressing or avoiding fire in a separation tank of claim 6, wherein the fire suppression material inlet is connected to a container of fire suppression materials.

9. The method of suppressing or avoiding fire in a separation tank of claim 6, wherein the oil recovery pipe valve can be remotely operated to shut off flow from said holding tank and initiate flow of said fire suppression materials into said tank.

10. A method of suppressing or avoiding fire in a separation tank comprising the steps of:

a) introducing a quantity of water and oil into a separation tank;
b) allowing said oil and water to separate;
c) selectively removing oil from said separation tank using a system of floats to maintain an oil drain opening above said water connected to an oil recovery pipe;
d) selectively removing vapor from said separation tank using a vacuum apparatus connected to said oil recovery pipe located above said oil drain opening, wherein said vacuum apparatus has a hose connected to said oil recovery pipe for removing vapor from said holding tank;
e) providing an oil recovery pipe valve on said oil recovery pipe outside of said holding tank for selectively allowing or disallowing flow of fluids out of the holding tank to a downstream location;
f) providing a fire suppression pipe in parallel with said oil recovery pipe for providing fire suppression materials to into said tank.

* * * * *